US005685568A

United States Patent [19]

Pirrello

[11] Patent Number: 5,685,568

[45] Date of Patent: Nov. 11, 1997

[54] PROTECTIVE HOLDER AND DISPLAY APPARATUS FOR BUSINESS CARDS

[76] Inventor: Roberta Pirrello, 387 Woodbury Rd., Woodbury, N.Y. 11797

[21] Appl. No.: 744,001

[22] Filed: Nov. 4, 1996

[51] Int. Cl.[6] ..... B42D 3/00

[52] U.S. Cl. ..... 281/33; 281/45

[58] Field of Search ..... 281/15.1, 21.1, 281/29, 31, 37, 33, 38, 51; 402/70, 73, 79, 4

[56] References Cited

U.S. PATENT DOCUMENTS

| | | | |
|---|---|---|---|
| 4,537,380 | 8/1985 | Erickson | 281/33 X |
| 4,586,729 | 5/1986 | Beylerian | 281/45 X |
| 4,949,484 | 8/1990 | Finger | 40/360 |
| 5,007,191 | 4/1991 | Klein | 40/638 |
| 5,083,391 | 1/1992 | Kyler | 40/642 |
| 5,092,062 | 3/1992 | Palka | 40/124.2 |
| 5,282,690 | 2/1994 | Moseley . | |
| 5,634,668 | 6/1997 | Barreiro, Jr. | 281/33 |

*Primary Examiner*—Willmon Fridie, Jr.
*Attorney, Agent, or Firm*—John R. Mugno

[57] ABSTRACT

An apparatus for holding a plurality of cards having a first surface providing visual indicia thereon and permitting selective removal of same is provided wherein said apparatus comprises: (i) binding means common along the first edge of said plurality of cards which permits selectable detachment of individual ones of said plurality of cards; (ii) a flexible cover including an inside surface and an outside surface and also having a first edge coupled to the binding means, said inside surface extendable around said plurality of cards, and a second opposite edge flexibly extendable beyond said binding means; and (iii) detachable adhering means on said inside surface of said cover near said second edge selectively usable in either of a carrying position whereby said adhering means adjoins the inside surface of said cover with the outside surface of said cover in a generally secure manner which substantially envelopes said plurality of cards and a second display position whereby said adhering means is coupled to said binding means in a manner such that said apparatus is free-standing.

20 Claims, 2 Drawing Sheets

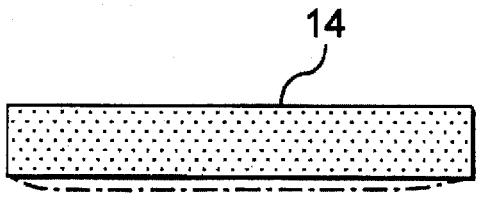
FIG. 1A
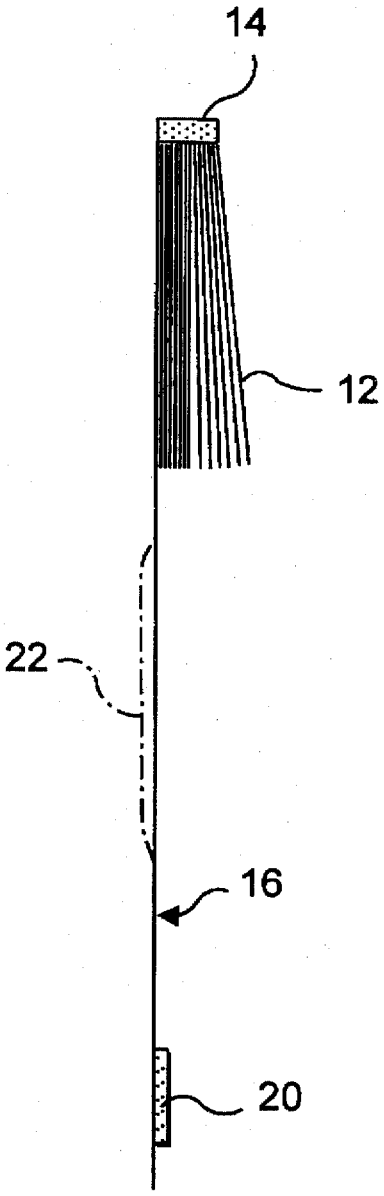
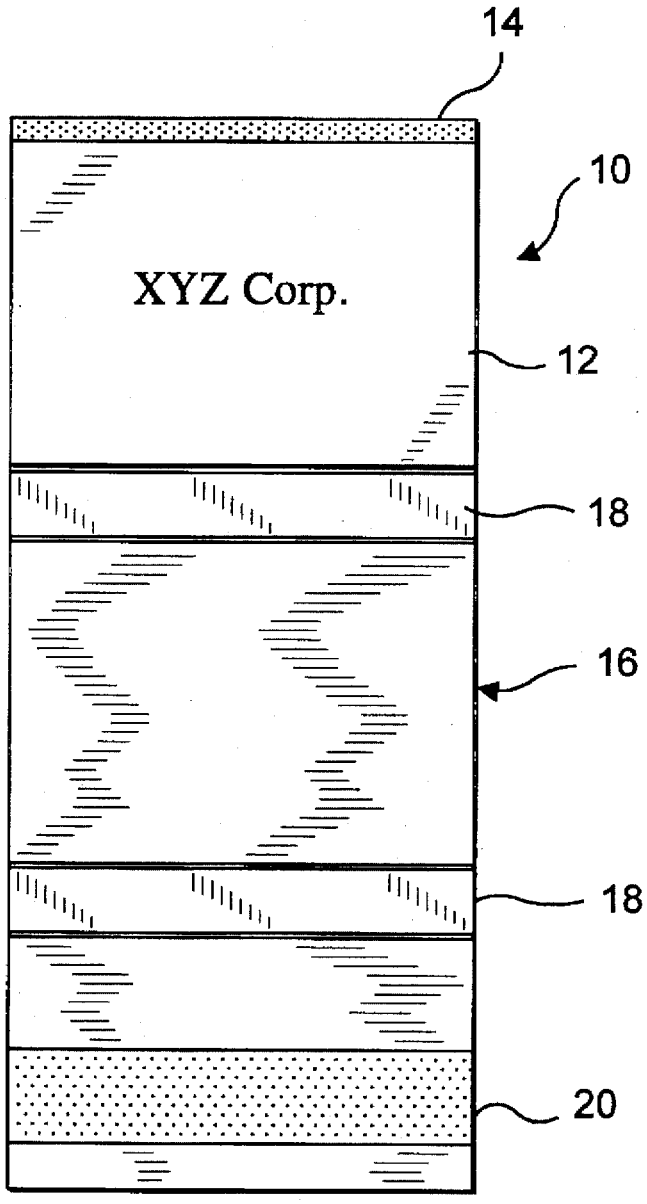
FIG. 1B
FIG. 1

PROTECTIVE HOLDER AND DISPLAY APPARATUS FOR BUSINESS CARDS

FIELD OF THE INVENTION

This invention is generally directed to a business card holder and, more specifically, to an inexpensive apparatus which can be used both as a protective cover for carrying a plurality of business cards and a free-standing display for said cards.

BACKGROUND OF THE INVENTION

In the prior art, there are a multitude of cases for carrying business cards to meetings and the like. Such cases range from inexpensive foldable plastic carriers to gold cases which might include a calculator, clock or some other electronic device. One problem with all prior card cases is that they are too narrow to hold a multitude of cards at one time. Others are heavy and weigh down a woman's purse or a man's pocket even without the cards inserted therein. Therefore, most people who hand out business cards on a regular basis are forced to simply place a multitude in their wallets, purses, pockets, or other places where the cards become dirty and the corners bend from lack of protection. When finally handing out such soiled or bent cards, embarrassing apologies are usually warranted.

The more expensive and ornate card cases, while invoking a certain high status, suffer from the same shortcomings as the inexpensive prior art cases plus are easily subject to loss or theft resulting in a significant loss of money.

Another problem associated with business cards is that a device separate from the card case must be incorporated to display the written indicia on the card in certain settings. Thus, for example, where a person is attending a business meeting when it is perhaps necessary to display a plurality of cards (or place card) in front of that person's locale, a plurality of cards must be removed from the carrying case, placed in a card holder for display, and untaken cards ultimately returned to the carrying case. This constant handling can further bend or soil the cards. Furthermore, if the plurality of cards is mishandled while transferring them to or from either the carrying case or the display apparatus, the plurality of cards could scatter on the ground causing embarrassment and undue time in regathering the cards.

Another often encountered shortcoming when using business cards can occur when a single entity utilizes a "team" of individuals to perform a certain function. For instance, in many accounting settings involving major corporations, it is common for the accounting firm to send at least a managing partner, an audit specialist, a tax return specialist, a customs expert, and perhaps several additional specialists. At such meetings, the client (which also might have several persons attending the meeting) is inundated with a series of individual business cards reflecting each specialist. It would certainly be more advantageous to provide a single packet of cards which might include the accounting firm's name on the front cover and individual cards for each specialist contained therein in a manner in which the cards could not become detached unless so desired.

It is, therefore, a primary object of the present invention to provide a new and improved apparatus for carrying and displaying a plurality of business cards.

It is another object of the present invention to provide a new and improved apparatus for carrying and displaying a plurality of business cards whereby said plurality of cards are initially attached but can be selectively detached.

It is yet another object of the present invention to provide a new and improved apparatus for carrying and displaying a plurality of business cards which can be inexpensively manufactured.

It is a further object of the present invention to provide a new and improved apparatus for carrying and displaying a plurality of business cards wherein said apparatus is disposable after use.

It is an additional object of the present invention to provide a new and improved apparatus for carrying and displaying a plurality of business cards wherein each of said plurality of business cards includes the same visual indicia thereon.

It is still another object of the present invention to provide a new and improved apparatus for carrying and displaying a plurality of business cards wherein each of said plurality of business cards includes different visual indicia thereon.

Further objects and advantages of the present invention will become apparent as the following description proceeds.

SUMMARY OF THE INVENTION

Briefly stated and in accordance with the preferred embodiment of the present invention, an apparatus for holding a plurality of cards having a first surface providing visual indicia thereon and permitting selective removal of same is provided wherein said apparatus comprises: (i) binding means common along the first edge of said plurality of cards which permits selectable detachment of individual ones of said plurality of cards; (ii) a flexible cover including an inside surface and an outside surface and also having a first edge coupled to the binding means, said inside surface extendable around said plurality of cards, and a second opposite edge flexibly extendable beyond said binding means; and (iii) detachable adhering means on said inside surface of said cover near said second edge selectively usable in either of a carrying position whereby said adhering means adjoins the inside surface of said cover with the outside surface of said cover in a generally secure manner which substantially envelopes said plurality of cards and a second display position whereby said adhering means is coupled to said binding means in a manner such that said apparatus is free-standing on a flat surface.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the following description, taken in conjunction with the accompanying drawings, wherein:

FIG. 1 represents a front view, a side view, and a top view of an apparatus for carrying and displaying a plurality of cards in accordance with the present invention wherein said apparatus is in an open position;

DETAILED DESCRIPTION OF THE DRAWINGS

Figure 2:
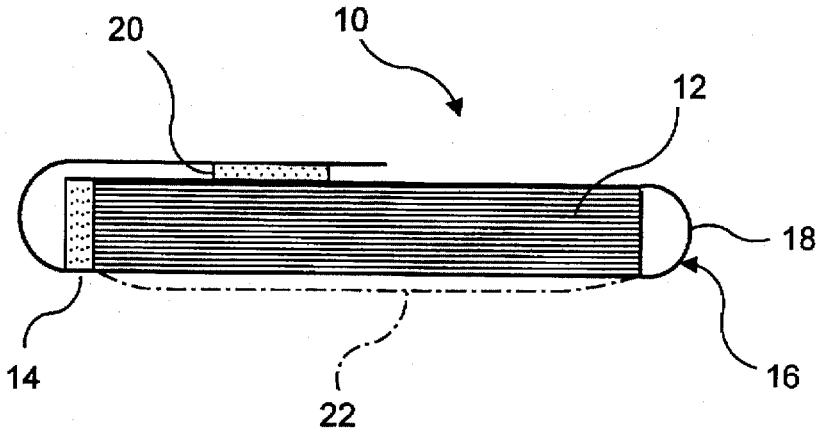
FIG. 2 is a perspective view of the apparatus for carrying and displaying a plurality of cards in accordance with the present invention wherein said apparatus is in a carrying position.

Referring first to FIG. 1, a card case and display apparatus, generally designated 10, is shown in three views in a position as if it were resting flat on table. Apparatus 10 includes a plurality of business cards 12 which are joined in a flat stack by binding means 14. Binding means 14 can be incorporated in numerous ways such as a small plastic clip or the like but is preferably comprised of an adhesive glue tab along one common edge of cards 12. The glue tab which can be used is similar to the one used on the binder of a legal pad whereby the individual sheets of the pad are coupled in a flat stack (with a top exposed flat surface) unless a user desires to detach the top sheet by tearing the sheet off in an edge-to-edge manner. It should be noted that the exposed surface of the top one of the plurality of cards 12 includes visual indicia, in this example, "XYZ Corp". The additional cards in the stack might incorporate identical visual indicia or different visual indicia thereon.

Still referring to FIG. 1, a cover 16 is shown which is flexible in nature particular along seams 18. Cover 16, which is basically flat in shape, can be understood to have an inside surface which is defined as the surface on which the plurality of cards 12 appear and an outside surface which is not visible in the front view of FIG. 1 since it would be resting on the underlying flat surface. Cover 16 can be comprised of plastic, a thick bond paper or other protective materials. Cover 16 includes on its inside surface an adhering means 20, which can be an adhesive tab and whose function will be described in connection with FIG. 2 and FIG. 3. While adhering means 20 is illustrated as extending along the entire width of cover 16, other variations are possible such as implementing a shorter adhesive tab or a series of glue spots.

Figure 3:
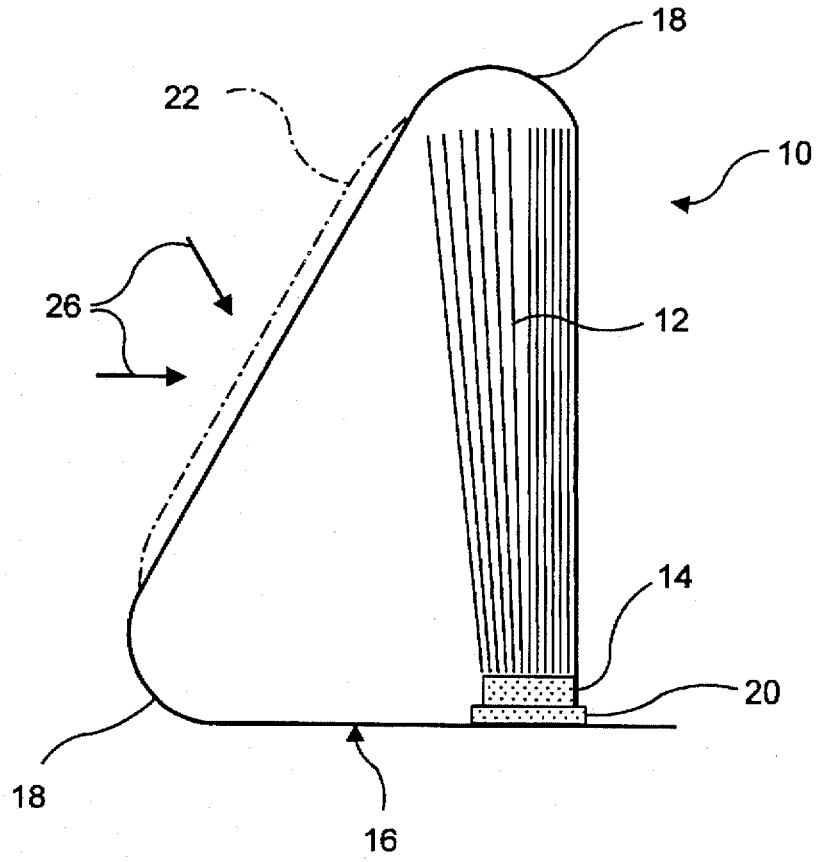
FIG. 3 is a perspective view of the apparatus for carrying and displaying a plurality of cards in accordance with the present invention wherein said apparatus is in a display position.

The outside surface of cover 16 can optionally include means for retaining and displaying a card which is separate from the plurality of cards 12. In FIG. 1, the retaining and displaying means is shown as a transparent plastic window 22. However, it will become apparent to those skilled in the art that the retaining and displaying means might also comprise simply a series of slots in which a flexible card can be bent slightly and then relaxed to fit the card's corners within the pre-positioned slots. Other retaining and displaying means such as a thin clip are also available. In use, the purpose of plastic window 22 is to permit a card with visual indicia thereon to be inserted in the plastic window. This placement of a card is particularly useful with regard to the display position of the apparatus which is shown in FIG. 3. It will be noted in FIG. 1 and FIG. 3 that no card has been placed in plastic window 22. However, at least one such card may be placed in plastic window 22 with its visual indicia projecting outward. Plastic window 22 has been described as optional since it may also be possible simply to place writing directly on the portion of the outside surface of cover 16 which would be visible in the display position, represented in FIG. 3. However, for mass production purposes, the use of a plastic window (or other retaining and displaying means) is advisable since it allows for non-custom production of cover 16.

Generally, in its open position of FIG. 1, apparatus 10 permits easy removal of individual ones of said plurality of cards 12. Again, the process can be most easily understood by considering how one would remove a sheet of paper from a legal pad. However, unlike a legal pad, apparatus 10 can also be positioned in a carrying mode (shown in FIG. 2) or a display mode (shown in FIG. 3). Referring specifically to FIG. 2, apparatus 10, in its carrying mode, allows cover 16 to generally encase cards 12 in a manner to eliminate wear and tear on cards 12. One edge of cover 16 is coupled to binding means 14; however, apparatus 10 can instead be manufactured by coupling this edge of cover 10 directly to the bottom card of the stack formed by cards 12. However, this later approach typically will render the bottom card unusable. Furthermore, adhering means 20 provides sufficient viscosity so that apparatus 10 will remain in its carrying mode until adhering means 20 is selectively detached from its mating position on the outside surface of cover 16.

In its display mode of FIG. 3, apparatus 10 is manipulated so that binding means 14 is situated to couple to adhering means 20. In FIG. 3, it is illustrated that any card placed in plastic window 22 (or, alternatively, any visual indicia directly on the outside surface of cover 16) will be visible to persons viewing apparatus 10 from the direction defined by arrows 26.

A major advantage of apparatus 10 of the present invention is provided when ordering new business cards. Typically such orders are made in bulk volumes such as 500 or 1,000 cards in order to keep printing costs low. While such large orders can be maintained when using apparatus 10, in fact, a plurality of separate "packs" typically containing anywhere from 15–50 cards can be provided. When the user is headed to a meeting, individual packs can be quickly and easily transported. These individual packs fit easily and conveniently in a purse, wallet, pocket or the like in a manner in which they do not become soiled or bent. When all cards in an individual pack have been distributed, the protective cover is simply discarded.

In the aforementioned description and the corresponding FIGURES, cover 16 has been described and illustrated as an integral piece of flexible material such as plastic. However, it is also foreseen by the inventors that cover 16 can be comprised of rigid or flexible composite elements joined by flexible seams 18. It is generally understood however that, based on present date manufacturing techniques, the integral covers are less costly to produce.

It will be apparent from the foregoing description that the present invention provides an economical and efficient apparatus for carrying and displaying a plurality of business cards. Importantly, the individual cards remain protected from wear and tear in an inexpensive carrying case which serves the dual function of also operating as a display apparatus.

While there has been shown and described what is presently considered the preferred embodiment of this invention, it will be obvious to those skilled in the art that various changes and modifications may be made without parting from the broader aspects of invention. For instance, although the invention has been described in connection with the use of business cards, it can be used to coordinate any sheet-like materials such as representations of slides, photographs and the like. Moreover, it is foreseen that the present invention can be utilized by an individual to disperse numerous individual ones of a plurality of business cards or as a complete packet to a third party.

It is, therefore, aimed in the appended claims to cover all such changes and modifications as fall within the true scope and spirit of the invention.

I claim:

1. An apparatus for holding a plurality of cards having a first surface providing visual indicia thereon and permitting selective removal of same comprising:

binding means common along a first edge of said plurality of cards which permits selectable detachment of individual ones of said plurality of cards;

a flexible cover including an inside surface and an outside surface and also having a first edge coupled to said binding means, said inside surface extendable around said plurality of cards, and a second opposite edge flexibly extendable beyond said binding means; and detachable adhering means on said inside surface of said cover near said second edge selectively usable in either of a carrying position whereby said adhering means adjoins the inside surface of said cover with the outside surface of said cover in a generally secure manner which substantially envelopes said plurality of cards and a display position whereby said adhering means is coupled to said binding means in a manner such that said apparatus is free-standing.

2. The apparatus of claim 1 wherein said binding means is an adhesive.

3. The apparatus of claim 1 wherein said flexible cover is comprised of flexible plastic.

4. The apparatus of claim 1 wherein said adhering means is an adhesive tab.

5. The apparatus of claim 1 wherein said outside surface of said cover includes visual indicia thereon.

6. The apparatus of claim 5 wherein said usual indicia on said cover corresponds to said visual indicia on said first surface of said plurality of cards.

7. The apparatus of claim 1 wherein the outer surface of said cover includes a transparent window for holding at least one card and exhibiting same when said apparatus is in said display position.

8. The apparatus of claim 1 wherein said cards are business cards.

9. The apparatus of claim 1 further comprising means for retaining and displaying a card separate from said plurality of cards on said outside surface of said cover.

10. The apparatus of claim 9 wherein said means for retaining and displaying is a transparent plastic window.

11. An apparatus for a plurality of cards having a carrying mode and a display mode comprising:

binding means along a first edge of said plurality of cards to create a selectable detachable flat stack of said cards;

a flexible cover including an inside surface, an outside surface, a first pair of opposite ends extending a length substantially equal to the length of said first edge of said plurality of cards, and a second pair of opposite ends extendable at least from a second edge of the bottom card of said back opposite said first edge, over a first surface of the top card of said stack, and beyond said binding means; and detachable adhering means on said inside surface of said cover wherein, in said carrying mode, said inside surface of said cover generally encloses said first surface of the top card of said stack, and, insert display mode, said adhering means is coupled to said binding means in a manner such that said apparatus is free-standing.

12. The apparatus of claim 11 wherein said binding means is an adhesive.

13. The apparatus of claim 11 wherein said flexible cover is comprised of flexible plastic.

14. The apparatus of claim 11 wherein said adhering means is an adhesive tab.

15. The apparatus of claim 11 wherein said outside surface of said cover includes visual indicia thereon.

16. The apparatus of claim 15 wherein said usual indicia on said cover corresponds to said visual indicia on said first surface of said plurality of cards.

17. The apparatus of claim 11 wherein the outer surface of said cover includes a transparent window for holding at least one card and exhibiting same when said apparatus is in said display position.

18. The apparatus of claim 11 wherein said cards are business cards.

19. The apparatus of claim 11 further comprising means for retaining and displaying a card separate from said plurality of cards on said outside surface of said cover.

20. The apparatus of claim 19 wherein said means for retaining and displaying is a transparent plastic window.

* * * * *